US007900391B1

(12) United States Patent
Mihelish

(10) Patent No.: US 7,900,391 B1
(45) Date of Patent: Mar. 8, 2011

(54) BORE SIGHT APPARATUS

(75) Inventor: Matthew P. Mihelish, Firth, ID (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 214 days.

(21) Appl. No.: 12/386,178

(22) Filed: Apr. 3, 2009

Related U.S. Application Data

(60) Provisional application No. 61/137,465, filed on Jul. 24, 2008.

(51) Int. Cl.
*F41G 1/00* (2006.01)

(52) U.S. Cl. ..... 42/116; 42/121; 42/134

(58) Field of Classification Search ..... 42/116, 42/121, 134, 70.01, 70.11, 90, 95, 106
See application file for complete search history.

(56) References Cited

U.S. PATENT DOCUMENTS

| | | | | | |
|---|---|---|---|---|---|
| 3,782,740 | A * | 1/1974 | Peyrot | 279/2.23 |
| 4,090,305 | A * | 5/1978 | Cassidy | 42/121 |
| 4,534,116 | A * | 8/1985 | Davis | 42/121 |
| 4,701,989 | A * | 10/1987 | Cayzer | 29/271 |
| 4,767,125 | A * | 8/1988 | Barry et al. | 279/2.12 |
| 4,773,164 | A * | 9/1988 | Taylor et al. | 33/520 |
| 4,825,258 | A * | 4/1989 | Whitson | 356/153 |
| 5,396,708 | A * | 3/1995 | Whitley | 42/121 |
| 5,448,834 | A * | 9/1995 | Huang | 42/116 |
| 5,618,099 | A * | 4/1997 | Brubacher | 362/111 |
| 6,289,624 | B1 * | 9/2001 | Hughes et al. | 42/116 |
| 6,289,782 | B1 | 9/2001 | Watson et al. | 89/37.01 |
| 6,295,753 | B1 * | 10/2001 | Thummel | 42/116 |
| 6,397,509 | B1 * | 6/2002 | Langner | 42/116 |
| 6,499,247 | B1 * | 12/2002 | Peterson | 42/116 |
| 7,325,354 | B2 | 2/2008 | Grauslys et al. | 42/131 |
| 7,665,218 | B1 * | 2/2010 | Pinto | 33/333 |
| 7,765,703 | B2 * | 8/2010 | Buckus | 33/286 |
| 2006/0265929 | A1 * | 11/2006 | Haney | 42/116 |

* cited by examiner

*Primary Examiner* — Michelle Clement
(74) *Attorney, Agent, or Firm* — Gerhard W. Thielman, Esq.

(57) ABSTRACT

An apparatus is provided for traversing a barrel of a gun and disposing at a select position therein. The apparatus includes a bore-rider assembly and a sight-mount assembly. The bore-rider assembly enters a muzzle of the barrel, slides within a bore of the barrel, and anchors to the select position. The sight-mount assembly projects a line-of-sight from the select position to the muzzle. The bore-rider assembly includes a rod having wedges, first and second bore-riders with proximal and distal ends, a sleeve couple that joins at axial ends the bore-riders in tandem from their proximal ends. Each bore-rider has a rim at the distal end and an extension at the proximal end. The rim has an outer diameter adjustable by expansion. The sleeve couple joins in tandem at each axial end each bore-rider from the proximal end. The rod passes through each bore-rider and the couple. The rod includes first and second wedges that engage their corresponding bore-riders. The rim includes an angularly symmetric plurality of slits therethrough. The slits continuously extend into the extension. The extension includes an axial chamber through which a spring passes through to provide tension for the rod. Cables extend fore and aft of the device and at a slit of the nearest bore-rider and loop around the corresponding extension.

12 Claims, 10 Drawing Sheets

BORE SIGHT APPARATUS

CROSS REFERENCE TO RELATED APPLICATION

Pursuant to 35 U.S.C. §119, the benefit of priority from provisional application 61/137,465, with a filing date of Jul. 24, 2008, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to bore sight alignment of a gun. In particular, the invention provides an apparatus using commercially available components with modest modification to enter the muzzle and traverse the bore of the gun.

A muzzle bore sight enables precise alignment of a gun onto a specified target by ballistic trajectory. Such tasks are routinely conducted by engineers and gun crews to precisely align the gun. Gun alignment is pivotal to any type of testing being conducted with naval gunnery. Historically, naval guns were sighted by placing a bore telescope at the breech of the gun and aligning the telescope with cross hairs contained at the muzzle. The cross hairs are then aligned on a target within the guns range, allowing for the gun sight to be zeroed in on target.

Utilizing the ability to bore sight a gun gives gunners and engineers precise gun alignment with which to evaluate a guns performance. Empirically measuring gun performance, against theoretically engineered specifications, is crucial for proper evaluation of the gun's design and construction. Conventionally, precision fabrication of any device used to align the gun is of utmost importance, requiring precision machining of any bore sight device used to sight in any gun.

SUMMARY

Conventional gun-alignment devices yield disadvantages addressed by various exemplary embodiments of the present invention. In particular, various exemplary embodiments provide an apparatus for traversing a barrel of a gun and disposing at a select position therein. The apparatus includes a bore-rider assembly and a sight-mount assembly. These assemblies can optionally be fabricated from commercially available components.

In various exemplary embodiments, the bore-rider assembly enters a muzzle of the barrel, slides within a bore of the barrel, and anchors to the select position. The sight-mount assembly projects a line-of-sight from the select position to the muzzle.

In various exemplary embodiments, the bore-rider assembly includes a rod having wedges, first and second bore-riders with proximal and distal ends, a sleeve couple that joins at axial ends the bore-riders in tandem from their proximal ends. Each bore-rider has a rim at the distal end and an extension at the proximal end. The rim has an outer diameter adjustable by expansion. The sleeve couple joins in tandem at each axial end each bore-rider from the proximal end. The rod passes through each bore-rider and the couple. The rod includes first and second wedges that engage their corresponding bore-riders.

Various exemplary embodiments also provide for the rim to include an angularly symmetric plurality of slits therethrough. The slits continuously extend into the extension. The extension includes an axial chamber through which a spring passes through to provide tension for the rod. Cables extend fore and aft of the device and at a slit of the nearest bore-rider and loop around the corresponding extension.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Cantilever moment due to the length of the gun barrel introduces an error caused by barrel droop. For a gun bore sighted at the muzzle, the projectile fires higher than alignment indication, resulting in target overshoot. This trajectory raising is caused by the barrel straightening as the gun fires due to gun blast pressure and the projectiles movement through the gun. Placement of a bore sight at the origin of bore (breech end) to negate barrel droop, reduces trajectory error to accurately align the gun on target.

Disposing the bore sight at the bore's origin has conventionally been accomplished with custom-designed precision-tolerance components, thereby raising expenditure. Universalizing an origin of bore sight reduces cost by reducing the number of instruments required for aligning various guns for test firing. Adaptability can include most guns sizes depending on the dimensions of instrument mounted on the bore sight. Cameras and lasers can be readily mounted on the bore sight depending on the test required of the gun. These specifications can be incorporated in various exemplary embodiments of the universalized origin of bore sight using a camera or a laser.

Conventional bore sights are of one solid machined component, disposed at the muzzle of the gun. This device employs three extendible contact pins, each pin having first and second positions for engagement and disengagement with the barrel interior surface. Depending on the model, each point of contact is of hardened steel or anodized aluminum allowing for smooth motion over the rifling of the barrel.

Several conventional techniques are employed to provide a concentric fit between the barrel and bore riders, while maintaining mobility in the bore. One method utilizes a spring-loaded contact pin at each support position, which creates an interference fit aligning the bore riders concentrically within the barrel. This design is complimented by its adaptability to changes in the inner bore diameter due to barrel fowling or erosion. Other designs that do not utilize the spring contact point require precise machining and tight tolerances to obtain a concentric fit. Such tight tolerance complicates insertion of the bore sight and often requires lubricants for installation.

Figure 1:
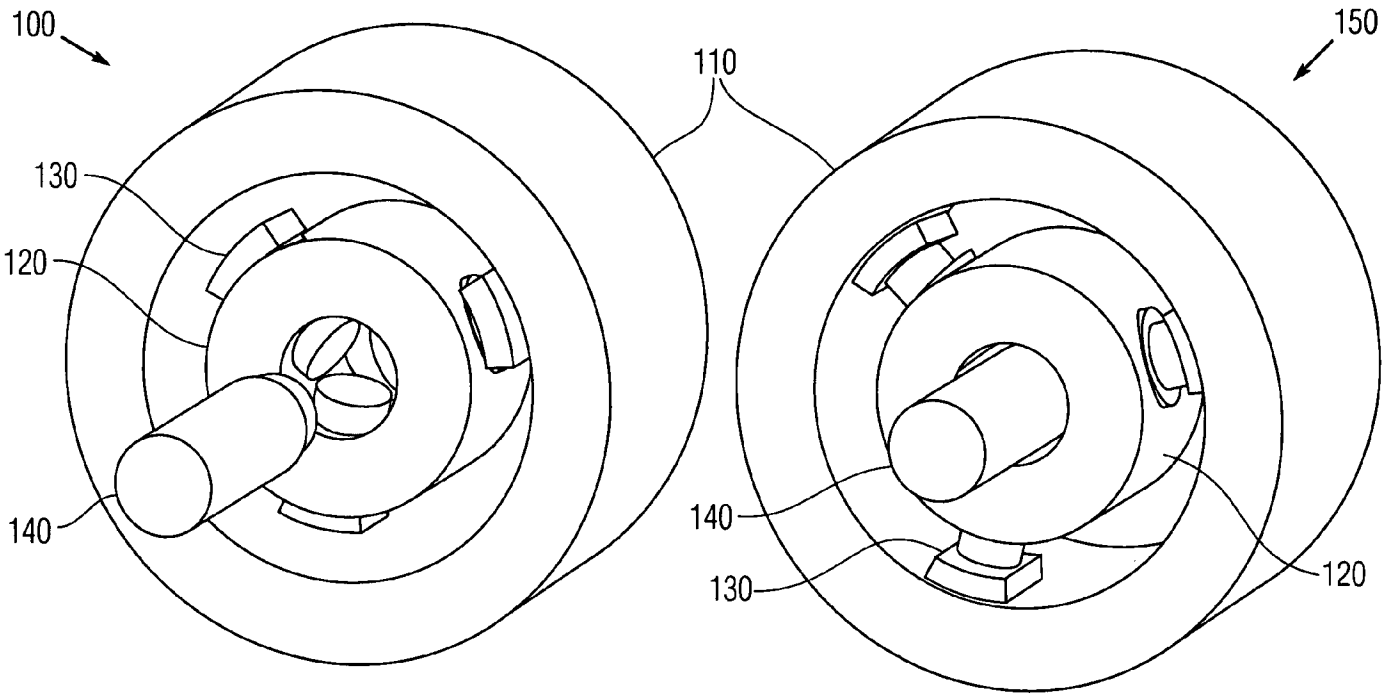
RELATED ART Fig. 1
FIG. 1 is a pair of isometric views of a star gauge alignment carrier.

FIG. 1 shows a pair of isometric views of a conventional star gauge alignment carrier. The star gauge assembly depicts the components for measuring inner bore diameter. The left view 100 shows a bore segment 110 along the axial centerline of a 57 mm barrel. A center star support 120 concentric to the centerline is disposed within the segment 110 and contains a triplet of equal-distant contact pins 130, shown disengaged from the inner diameter of the segment 110. A tapered rod 140 having cylindrical proximal and conical distal ends is disposed along the centerline. As the rod 140 translates towards the support 120, the distal end engages the pins 130 extending them radially outward, as shown in the right view 150. Moving the rod 140 linearly forward forces the pins to the exact inner bore diameter of a 57 mm barrel, thereby enabling alignment.

Another conventional configuration uses two positions of contact but incorporates six contact pins at each position. These bore-riders include metal tongs forming a tapered conical shape. The tongs allow for equal displacement when inserted into a barrel maintain concentricity within the barrel regardless of inner diameter.

Various types of bore sights use either an optic eye piece or laser for target alignment. An example of an optic eye piece would be a telescope with 90°-view attached to the bore rider. This enables an operator to view the desired target from the muzzle and align the gun accordingly. Replacing the telescope with a laser enables targeting by positioning the reflection dot on the target, which can accelerate gun target alignment. Camera bore sights use lenses and sophisticated closed couple device cameras mounted in line with the telescope relaying video back to personnel that control gun movement. This technique enables precise target tracking viewed from within the barrel.

Incorporating the previously cited above features into a universal bore sight provides the rationale for the configuration represented in various exemplary embodiments. Such a bore sight device can preferably be designed and fabricated for adaptation to multiple bore sizes. This device preferably also contain features to mount a camera and lens capable of viewing the target range of the gun being sighted, or alternatively to mount a laser for a secondary measure to sight the gun on target. The universal bore sight is capable of being disposed in any position along the axis of the barrel, from the muzzle to the origin of the bore.

Researching and examining several preexisting bore sight designs led to the option of adapting the star gauge to act as bore-riders, which would center within the bore of any gun placed in. The star gauge represents a device used to precisely measure the inner bore diameter of guns, ranging from 3-inch to 16-inch with accuracy to a ten-thousandth of inch. The gauge operates by inserting a head socket, attached to a connecting rod to a desired depth within the barrel. Upon reaching this depth, the connecting rod pushes a conical wedge into a head socket extruding out measuring points equally. These measuring points then contact the lands of the barrel and an inner bore diameter can then be measured. Assuming self-centering during this process, the star gauge provides a useful mechanism for aligning either a camera or laser within the bore of a gun. By varying the lengths of contact pins, the star gauge could be easily adaptable to multiple guns.

A pair of coupled star gauges can be combined with the ability to expand simultaneously. The camera or laser can be attached to the star gauges to produce a bore sight capable of centering itself within the bore of a gun. Due to the reliability placed on the star gauges ability to accurately measure inner bore diameters to within ten-thousandths of an inch, this design was considered to be precise and a feasible design. This particular configuration is discarded for these purposes due to design complicity and resultant time needed for manufacture.

Various exemplary embodiments provide Step-Collet Bore Riders with a Couple. Artisans of ordinary skill will recognize that a collet constitutes a holding device—specifically, a subtype of chuck—that forms a collar around the object to be held and exerts a strong clamping force on the object when tightened via a tapered outer collar to hold a workpiece or a tool. Generally, a collet chuck, considered as a unit, includes a tapered receiving sleeve (often integral with the machine spindle), the collet proper (usually composed of spring steel), which is inserted into the receiving sleeve, and (often) a cap that screws over the collet, clamping it via another taper.

Typically in shop-floor terminology, the terms "collet" and "chuck" are used in contradistinction; users describe holding a workpiece or tool with either a collet or a chuck. This usage refers to the same distinction as does a collet chuck or alternatively another type of chuck (scroll chuck, independent-jaw chuck, etc.). The terms collet and chuck are substantially interchangeable. The principle difference involves conceiving the overall chain of connection between the machine spindle and the item being attached thereto (workpiece or tool). Generally, the overall system of holding constitutes a chuck, but practically, the receiving sleeve for a collet is often integral with the machine spindle, and from the point of view of naming the parts that are added on to the spindle, they are either a collet (with or without a cap) or a chuck (such as a scroll chuck).

Figure 2A:
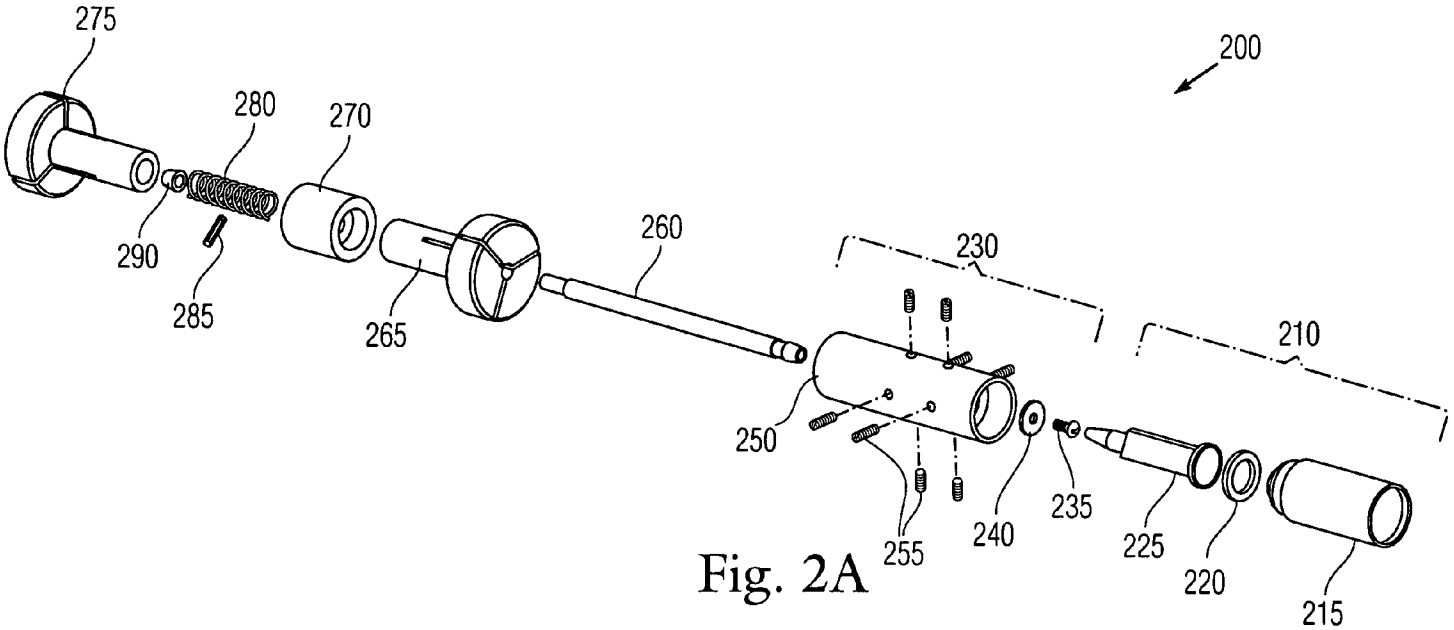
FIGS. 2A and 2B are a pair of isometric exploded views of a camera bore sight assembly.
Figure 2C:
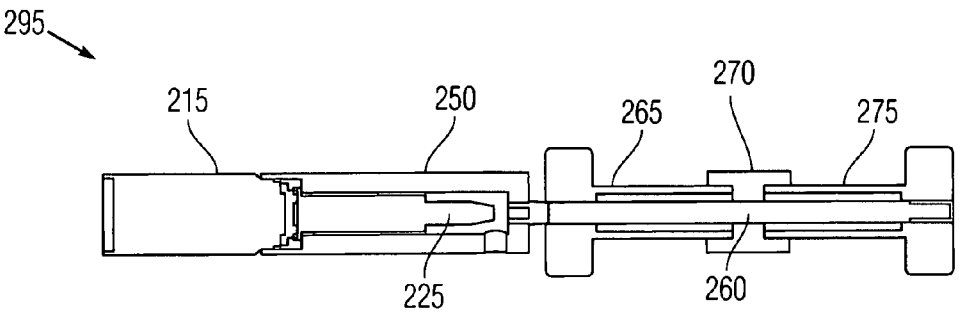
FIG. 2C is an elevation view of the camera bore sight assembly.
Figure 2B:
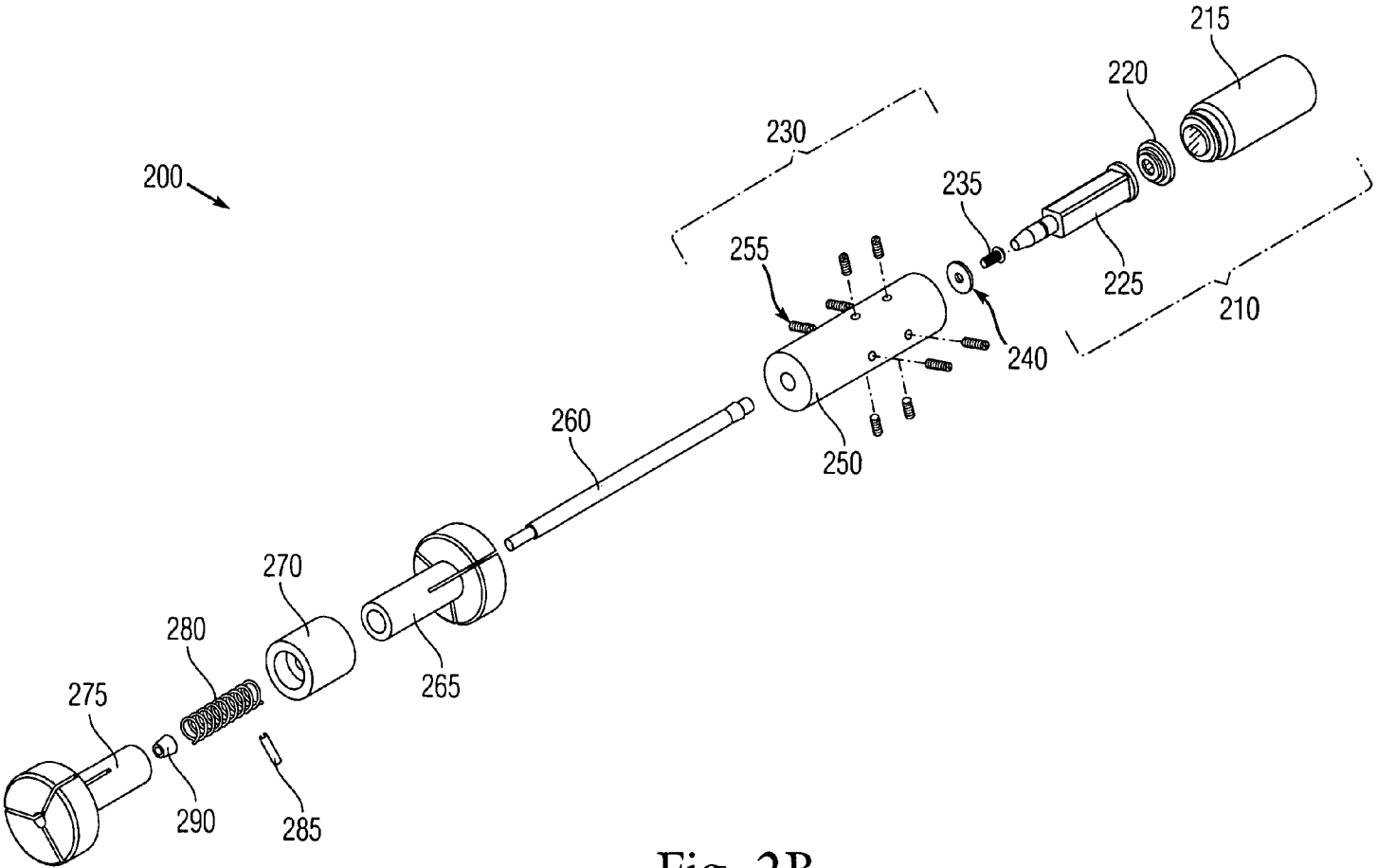

Components from various exemplary embodiments of the universal bore sight can be examined at FIGS. 2A and 2B in isometric exploded views 200. FIG. 2A shows the exploded view looking somewhat aft from the fore. FIG. 2B shows the exploded view looking somewhat forward from the rear. A camera assembly 210 at the fore includes a 100 mm lens 215, a 2× magnification lens 220, an XC-555 camera 225. A camera-mount module assembly 230 is disposed behind the camera assembly 210, including a securing bolt 235, a washer 240 and a camera tube 250 with several set screws 255 arranged in cruciform pattern along the exterior of the tube 250. Artisans of ordinary skill will recognize that the camera 225 can be replaced with a laser-sight without departing from the scope of the invention.

The bore sight assembly also includes a wedge rod 260, a fore bore-rider 265, a rider coupler 270, an aft bore-rider 275, a helical spring 280, a spring pin 285 and a tapered wedge nut 290. FIG. 2C shows an elevation cross-sectional view of a universal bore sight assembly 295. The camera 225 inserts into the tube 250, which attaches to the rod 260 passing through the bore-riders 265, 275 and the couple 270. The nut 290 attaches to an aft end of the rod 260.

Figure 3:
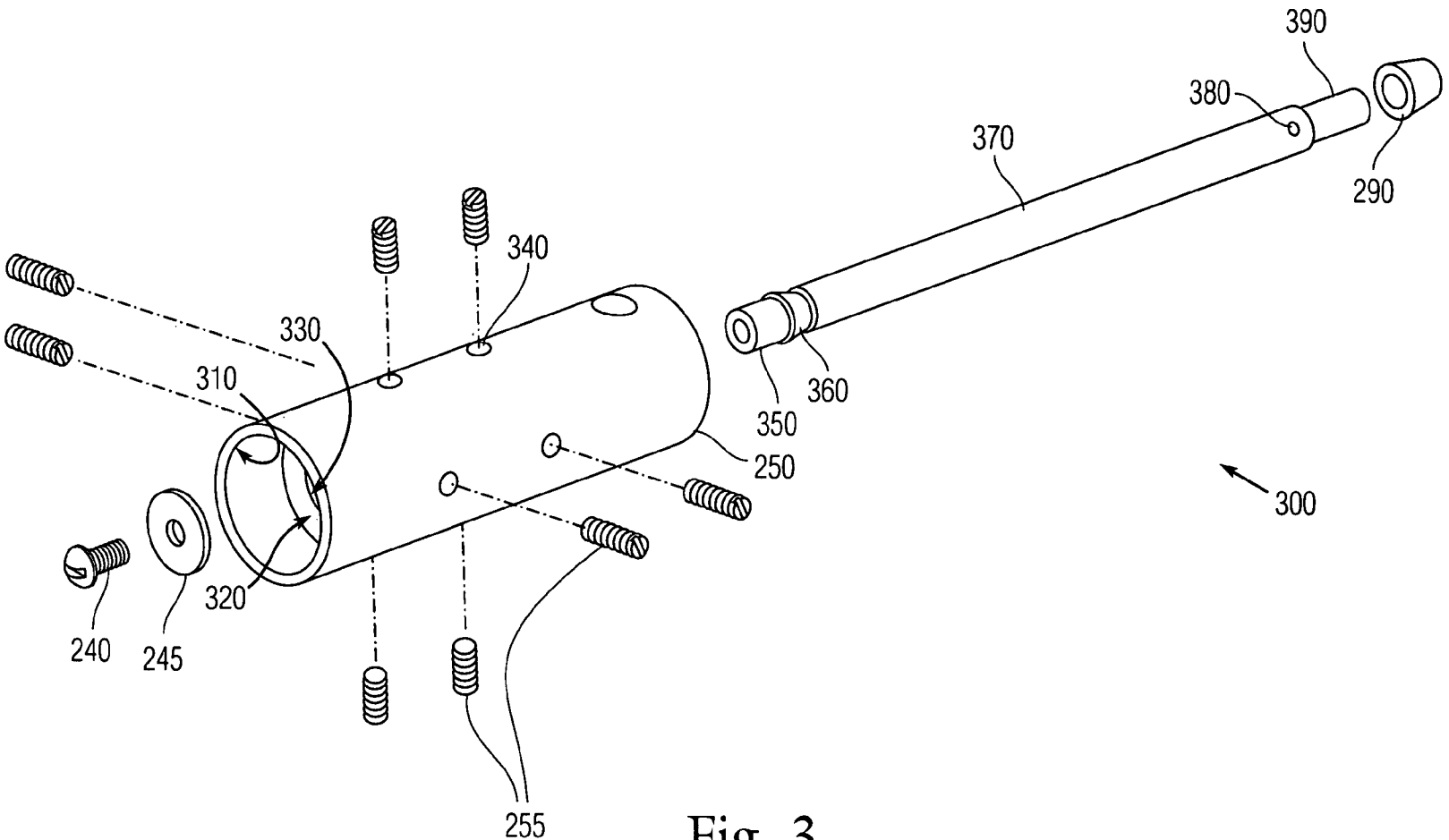
FIG. 3 is an isometric exploded view of a camera clamp assembly.

FIG. 3 shows an exploded isometric view 300 of the module assembly 230, which primarily includes the wedge rod 260 and the camera tube 250 aligned to each other and to the bore-riders 265, 275. The tube 250 includes an insertion cavity with an inner surface 310 to receive the 2× lens 220, an annular landing 320 initiating a chamber having an inner surface 330 to receive the camera 225. The tube 250 includes orifices 340 into which the set screws 255 can be inserted to secure the camera 225.

The rod 260 includes a fore button 350 with a truncated conical wedge or flare 360 that extends beyond the diameter of the shaft 370. The rod 260 includes an orifice 380 into the cylindrical exterior through which the pin 380 can be inserted. The orifice is disposed near an aft end 390 opposite to the fore button 350. The aft end 390 receives the nut 290 to inhibit axial translation.

Figure 4:
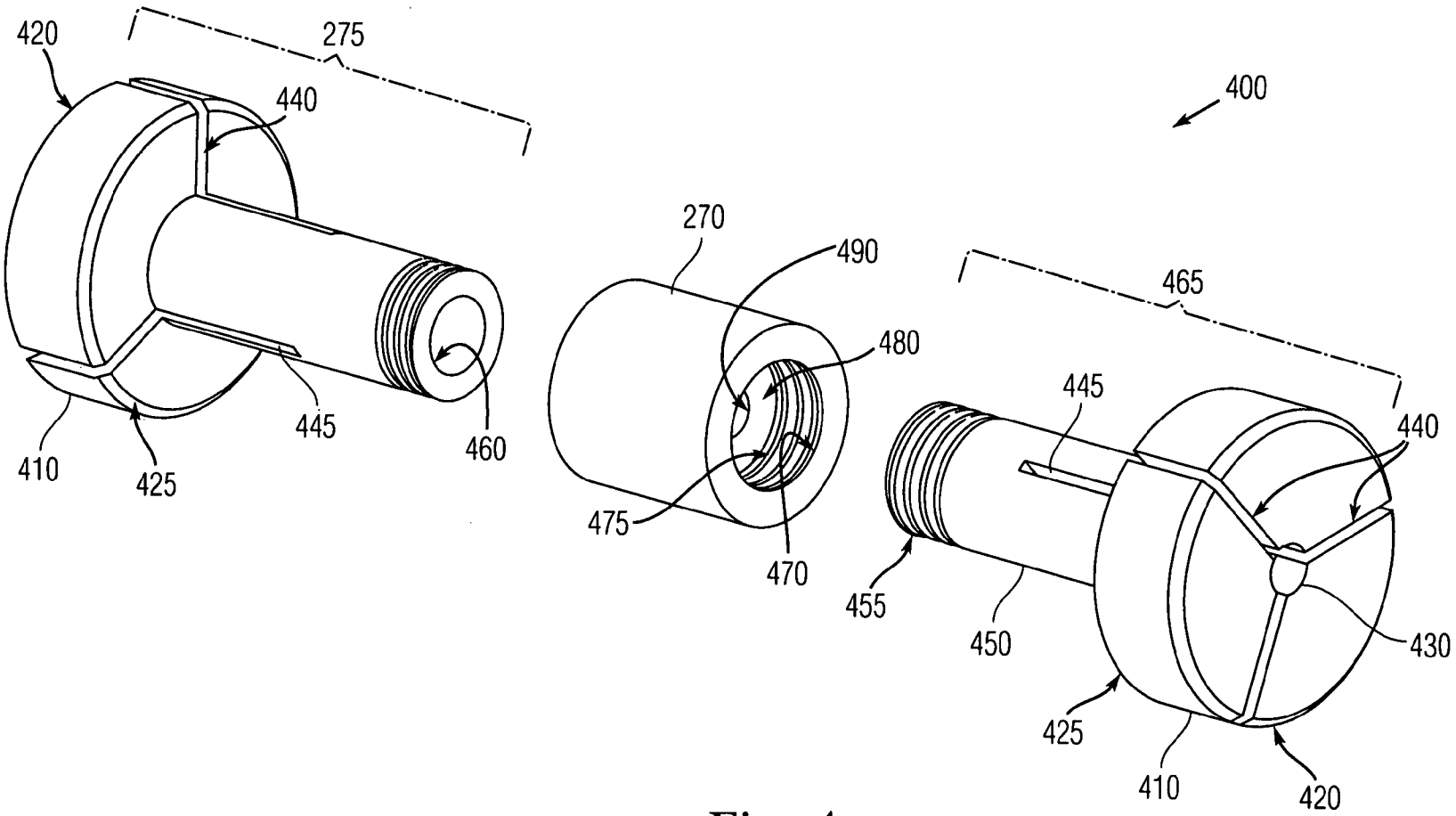
FIG. 4 is an isometric exploded view of a bore rider assembly.

FIG. 4 shows an exploded isometric view 400 of the pair of collets concentrically connected by the couple 270, to form bore-riders 265, 275 upon assembly for the bore sight. Each collet includes an outer rim 410 at its proximal end, bounded axially by an aft chamfer 420 and a fore chamfer 425. An axial channel 430 extends through the rim 410 to receive the rod 260. The rims 410 represent the portions of the bore-riders 265, 275 that engage the barrel's bore.

A triplet of proximal slits 440 divides the rim 410 into equal angular portions to form 120° angular separation. The proximal slits 440 are continuous with distal slits 445 on an extension 450 that engages the couple 270 at the collet's distal end. The distal slits 445 linearly diminish their depths with increasing distance from the rim 410. The extension 450 includes male screw threads 455 along the outer extent at the distal end and a cavity having an inner surface 460 with a diameter not less than that of the channel 430.

Figure 5:
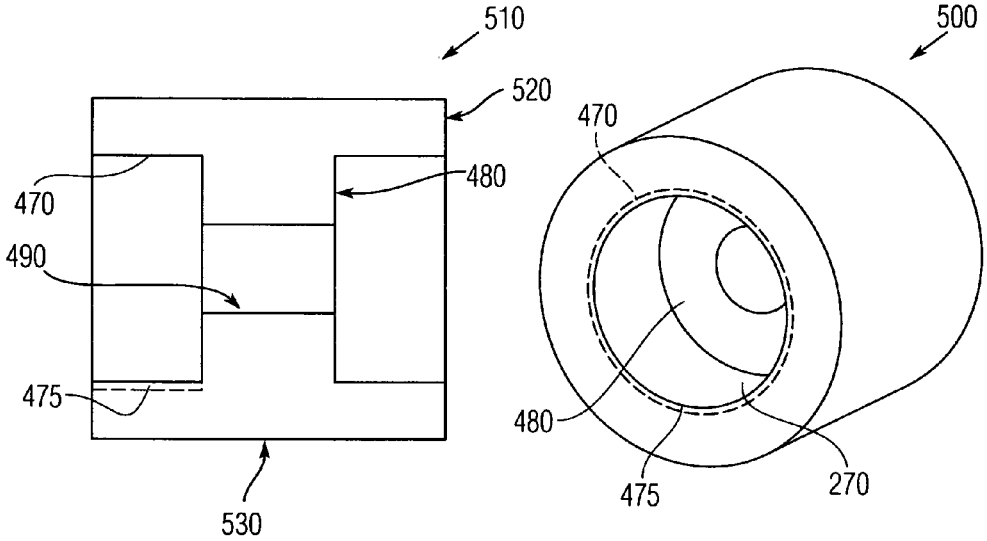
FIG. 5 is an elevation and isometric view of a pipe fitting.

The couple 270 includes an inner surface 470 with female screw threads 475 to receive the counterpart male screw threads 455 of the collet's extension 450. The couple 270 also includes a landing 480 for the collet's distal end and an inner annular chamber 490 for the rod 260. FIG. 5 illustrates an isometric view 500 and an elevation cross-section view 510 of the couple 270, which has axial ends 520 defined by a cylindrical rim 530.

Figure 6:
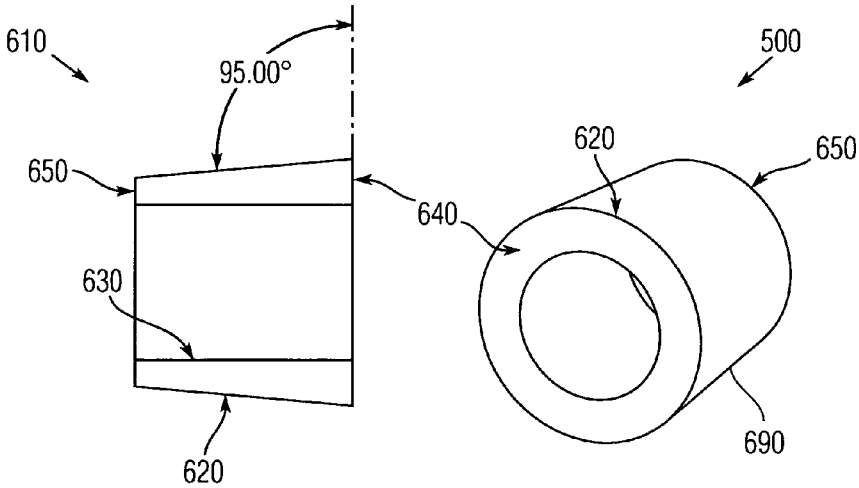
FIG. 6 is an elevation and isometric view of a tapered nut.

FIG. 6 illustrates an isometric view 600 and an elevation cross-section view 610 of the nut 290. The tapered outer surface 620 is defined by a frustum, whereas the inner surface 630 is cylindrical. The nut's outer surface diminishes from its fore end 640 towards its aft end 650 by an angle slope of 95° from vertical rendering a radial 5° wedge from aft to fore that engages the channel 430 of the aft bore-rider 275.

Figure 7:
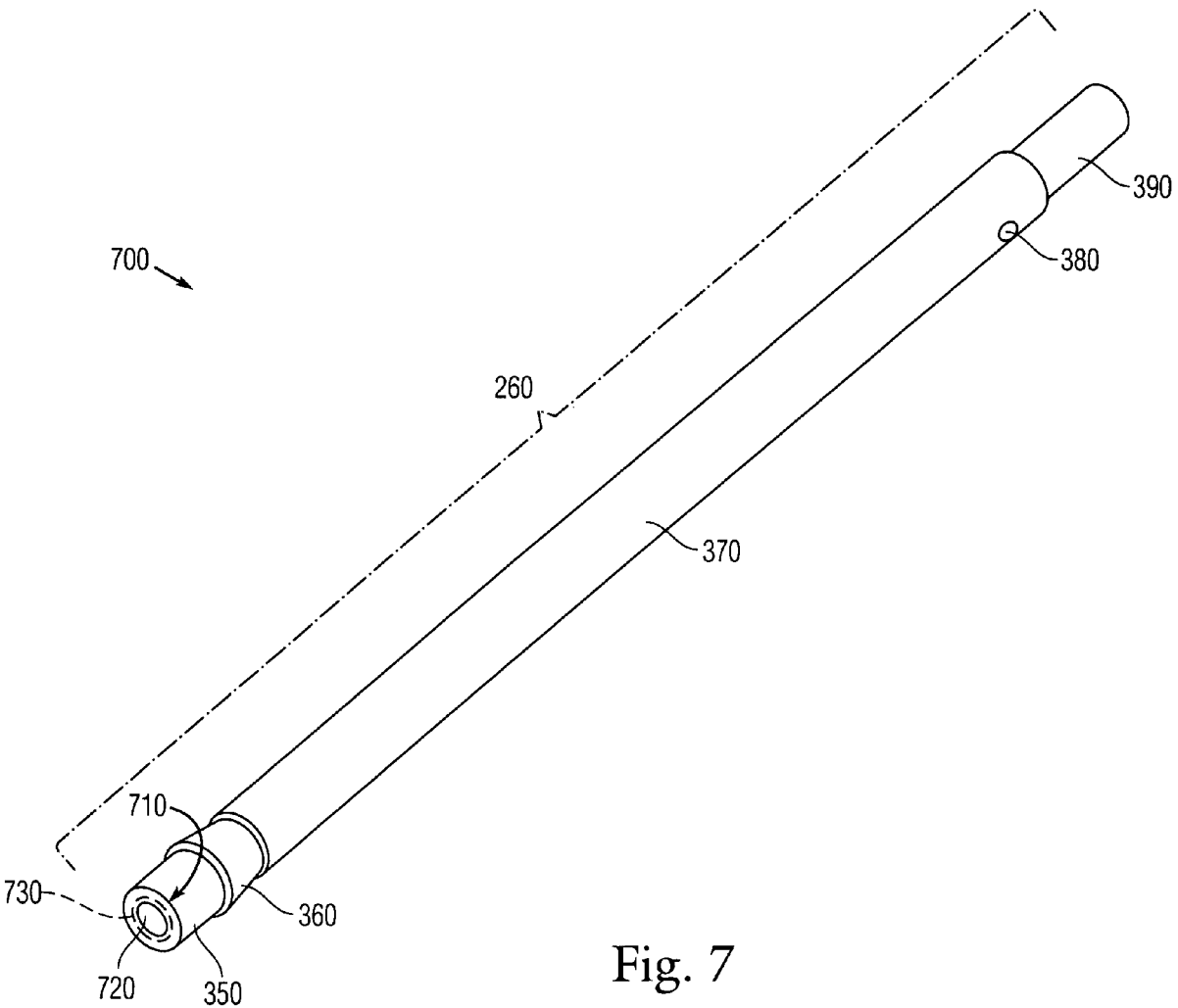
FIG. 7 is an isometric view of a wedge shaft.

FIG. 7 illustrates an isometric view 700 of the rod 260. The fore button 350 includes an outer rim extent 710, an inner bore 720 and screw threads 730 to receive the screw 240. The flare 360, tandem to and terminating at the button 350, includes a radial 5° wedge from aft to fore so that its ridge engages the channel 430 of the fore bore-rider 265, and an annular land at the forward end of the flare 360 abuts against the aft surface of the tube 250.

The bore-riders 265 and 275 employ collets as a practical solution to the design criteria, after consideration of several alternate bore sight designs. Collets are used in a metal lathe to hold irregularly sized objects while being turned in the lathe. Typically, these are made from relatively soft metal allowing for them to be machined fitting the desired size of the irregularly dimensioned object. The collets also have the unique ability to clasp objects by the partial separation into three sections. This allows the collets outer diameter to increase or decrease to some limited amount. This feature enables the collet's rim to match any diameter of the bore, while being moved throughout the gun.

By coupling two collets in tandem, end to end, provides the bore-riders sufficient support for concentric fit in the gun barrel. Also, staying within the dimensional boundary conditions of the straightness gauge, ensures the bore-riders fit throughout the bore length. This design takes advantage of cost off the shelf items, significantly reducing the cost of fabricating the exemplary designs. Commercially available collets can be purchased in a variety of sizes, enabling the device to be adaptable to multiple bore sizes.

Collets can be purchased in a variety of outer diameter sizes, allowing them to fit most guns, which gives the bore sight adaptability. The collets incorporated for the bore-riders 265, 275 are standard items from the auto industry at about $37 apiece, and as originally purchased have rims 410 with 3-inch outer diameter. The exemplary bore-riders 265, 275 were obtained by modification of Lyndex 550-003 step collets. These can be obtained from Lyndex-Nikken, Inc., 1468 Armour Blvd., Mundelein, Ill. 60060, Tel: 800-543-6237, Fax: 847-367-4815. The original outer diameter of 3.00-inch for the rim 410 was machined down to 2.983-inch for the 76 mm bore to be tested. Machining of the collets was accomplished by a lathe using a ½-inch dowel for insertion in the channel 430 to inhibit rim deflection.

The distal slits 445 terminate prior to farthest extent of the threads 455, which are set to 1.238-inch male. The coupling 270 is configured to correspond with female threads 475. The coupling 270 includes an external rim 530 having an outer diameter, a distal inner diameter (both ends) terminating in the flat shoulder 480 perpendicular to longitudinal axis, and the annular chamber 490 of ½-inch diameter to enable the rod 260 to slide through. The rod 260 terminates at the fore with the flare 360 and the button protrusion 350. The rod 260 terminates at the aft end with the lateral orifice 380 to receive the pin 385 (to adjust spring tension) and an elongated threaded extension for the nut 290 with a radial 5° wedge. The nut 290 unscrews to remove the rod 260 from the assembly of bore-riders 265, 275 and couple 270.

Figure 8:
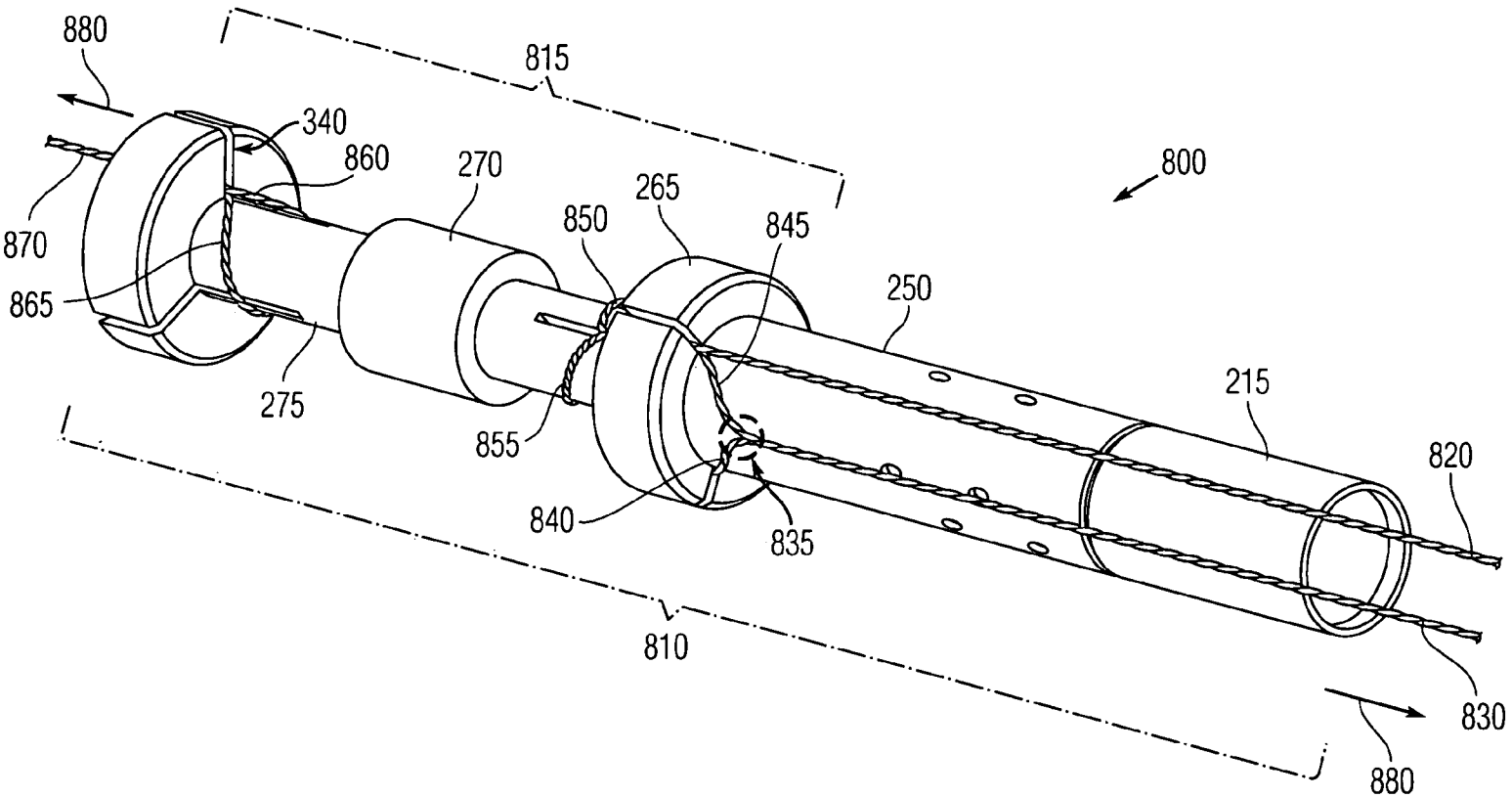
FIG. 8 is an isometric assembly view of the camera bore sight.

FIG. 8 illustrates an isometric view 800 of the bore sight assembly 395 in cooperation with cables to present an assembly package 810 to slide within the bore. The package 810 includes a bore-sight assembly 815 with the bore-riders 265, 275 connected to the couple 270. A front control cable 820 extends forward of the lens 215 towards insertion into a slit 445 of the fore bore-rider 265. Similarly, a camera module cable 830 also extends forward of the lens 215. The camera module cable 830 splits adjacent the camera tube 250 at a fork 835 into two slits 440 and around the flare 360 of the rod 260. The front control cable 820 passes through the slit 445 of the fore bore-rider 265 and splits behind the rim 410 to wrap around the extension 450 by cable loop portions 850 and 855.

Loop cable portions 860 and 865 join together through a slit 445 of the aft bore-rider 275 extending rearward to a rear control cable 870. The front cable 820 attaches to the front bore-rider 265 in a similar manner the rear cable 870 loops around the aft bore-rider 275. By tensile forces 880 pulling on the cables 820, 830, 870, the bore-riders 265, 275 disengage from the rod 260 for loosening against the bore to enable retrieval of the package 810 from the barrel 920. The front and rear control cables 820 and 870 loop around their respective bore-riders 265 and 275 through one of three slits 445. Such looping ensures lack of interference between the cables and their corresponding bore-riders during positioning the assembly package 810 in the gun bore.

Figure 9:
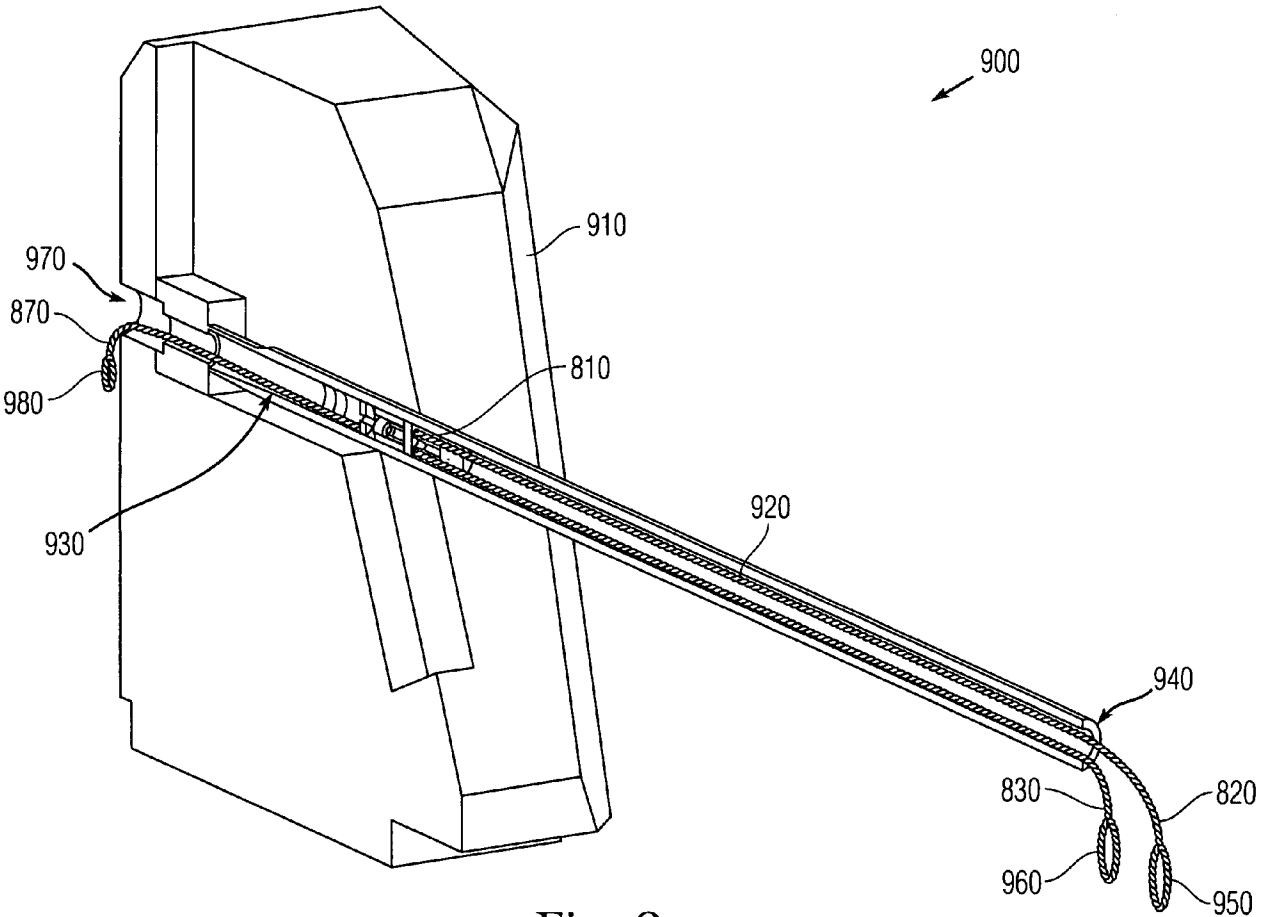
FIG. 9 is an isometric exploded view of bore sight installation in a gun.

FIG. 9 depicts an isometric sectional view 900 of a gun turret 910 with the bore sight assembly package 810 with cables. A gun within the turret 910 includes a barrel 920 having an origin 930 and a muzzle 940. The assembly package 810 is disposed within the barrel 920 with the cables 820, 830 extending beyond the muzzle 940 and terminating with respective muzzle cable handles 950, 960. The rear cable 870 extends through the origin 930 beyond a breech 970 terminating with a breech cable handle 980.

The rear cable 870 traverses the barrel 920 through the muzzle 940 and exits the gun through the breech 970, terminating at the handle 980. The front cable 820 follows the assembly package 810 through the barrel 920, and terminates at the handle 950. An operator at the breech 970 of the gun controls the rear cable 870, enabling the operator to pull the assembly package 810 through the gun bore during installation of the assembly package 810 by pulling the handle 980, and subsequently apply tensile force 880 to the cables 830 and 870 when removing the assembly package 810.

The tensile force 880 applied to the rear cable 870 can be used to secure the bore-rider assembly 815 in position from the handle 980, while the front cable 820 applies an opposite tensile force 880 to the module assembly 230 from the handle 950, which dislodges the aft-facing wedges from their respective channels 430 of the corresponding bore-riders 265, 275. Once dislodged, the rims 410 of the bore-riders 265, 275 relieve to their initial diameter and for extraction of the assembly package 810 from the gun bore. The front and module cables 820, 830 loop around aft of the module assembly 230, following the assembly package 810 into the gun bore during installation.

An operator at the muzzle 940 can subsequently pull the assembly package 810 out of the barrel 920. Alternatively, the operator can disengage the bore riders 265, 275 by pulling the module assembly 230 away from the bore-rider assembly 815, while maintaining the assembly package 810 within the barrel 920. The camera module cable 830 also follows the assembly package 810 through the muzzle 940 as a precautionary measure to enable additional force being applied for removing the assembly package 810 from the barrel 920.

Pulling the breech cable handle 980 rearward away from the breech 970, enables the assembly package 810 to traverse the bore from the muzzle 940 to the origin 930 of gun. Pulling either muzzle cable handle 960 or 950 forward away from the muzzle 940 (from forward of the gun) enables the assembly package 810 to traverse the bore towards the gun's muzzle 940. Engaging the bore-rider rims 410 against the bore requires the breech cable handle 980 be held in tension.

The muzzle cable handle 960 pulls until module assembly 230 separates from the bore-rider assembly 815. The spring 280 contacting the center of the inner shoulder 480 of the couple 270 inhibits further motion of the muzzle cable handle 960, which releases in response to achieve the spring-loaded position, thereby causing the module assembly 230 to spring back into the bore-rider assembly 815. This action forces the flare 360 and the nut 290 against the channels 430, thereby radially expanding the rims 410 to conform to and fit against the bore.

The bore-rider assembly 815 secures and aligns the assembly package 810 within the barrel 920 by expanding their outer rims 410 until tightly pressed radially against the bore. This is accomplished by pressing the bore-riders 265 and 275 axially by the flare 360 and nut 290, respectively at the fore and aft of the rod 260. The nut 290 secures to the aft end of the rod 260 by a threaded connection, thereby enabling the nut 290 to self-align along the longitudinal axis of the bore sight as the male screw threads 455 of the aft bore rider 275 rotates into female screw threads 475 of the couple 270. This process ensures that the both the flare 360 on the rod 260 and the nut 290 together contact the corresponding channels 430 on their respective bore-riders 265, 275 concurrently. Maintaining simultaneous contact with bore-riders 265, 275 ensures equal expansion and concentric fit within the bore of the barrel 920.

Removal of the secured bore-riders 265, 275 from the channel 430, requires the forces applied by the nut 290 and the flare 360 be displaced from their interference-fit positions merely by pulling the rod 260 out away from the bore-rider assembly 815. Within the barrel 920, this task can be accomplished with the two control cables 820 and 870, the rear cable 870 looped around the aft bore-rider 275 and the forward cable 820 looped around the fore bore-rider 265 past the aft portion of the module assembly 230.

The rear cable 870 attached to bore-rider 275 provides a resistive force as the module assembly 230 pulls away from the bore-rider assembly 815, therefore displacing the rod 260, relieving pressure against the bore-rider assembly 815. Upon release, the outer rims 410 of the bore-riders 265, 275 return to their original diameter (neutral state) to provide sufficient clearance for smooth removal of the bore sight assembly 810 from the bore of the gun barrel 920. The nut 290 secures to the rod 260 with a 0.375-16UNC-2B-THRU-THREAD readily being screwed on or off.

The muzzle terminals of entry for a bore sight device determines facility for traversing through the bore. Depending on the gun design, entering from the breech 970 requires only a short distance to be traveled before final position is reached at the origin 930 of bore. There, the bore-riders 265, 275 only encounter a small portion of rifling; extremely tight tolerances may be used without the possibility of the device jamming due to fowling of the barrel 920 from fired rounds. However, installing the bore-sight assembly 810 from the breech 970 requires extruding video and power cables through the complicated machinery used to operate the gun. In many cases, to access the breech 970 of a gun is impractical for operational applications.

Therefore, considering the design of the universal bore sight, insertion from the muzzle 940 is the most accessible choice of entry, involving less time to integrate the device within the origin 930 of bore. However, inner diameter changes along the length of the barrel 920, which introduces altering tight tolerance for the bore-rider through the inconsistencies of the bore. Although, moving the bore sight device through the muzzle 940 may be difficult, this represents the only practical point of entry to the origin 930 of bore.

Due to the accessibility of 76 mm barrels, an analysis of bore diameters was accomplished using data obtained from the star gauge, showing that a newly manufactured barrel changes one-thousandths of an inch from the muzzle 940 to the origin 930 of bore. In addition, naval regulations permit some increase in bore diameter at the muzzle 940. From these data, the bore-riders 265, 275 can be adapted to a variety of bore diameters to ensure concentricity and accurate gun alignment.

Placement of the bore sight at the origin 930 of bore depends on whether barrel droop extent suffices to introduce unacceptable error into tests. The error occurs under conditions of the bore sight mounted at the muzzle aligns the gun lower than the gun's actual aim point. A straightness gauge can be used to ensure that barrel droop remains within appropriate limits. The straightness gauge used for a 76 mm gun has the diameter of 75.92±0.03 mm, length of 330.2 mm, and straightness of ±0.03 mm. The bore-riders 265, 275 are designed within those limits to ensure uninterrupted movement of the bore sight throughout the bore of the 76 mm gun.

The flare 360 provides the compression to slam against the assembly to expand the rims 410 and wedge them in the barrel 920 of the gun being aligned. The flare 360 contacts the fore bore-rider 265. To set the assembly package 810 into position, the rod 260 is pulled forward and released —the spring 280 provides the tension force to ram the rod 260 rearward so that the flare 360 engages the edge of the channel 430 of the fore bore-rider 265. The force is provided by the cables 820, 830 connected to fore bore-rider 265 behind the module assembly 230. The rear cable 870 prevents the assembly package 810 from being pulled out of the bore, while the fore cable 820 provides tensile force. Upon relieving tensile force on the front cable 820, the rod 260 springs back into bore-rider assembly 815.

The exemplary couple 270 secures the bore-riders 265, 275 in tandem. Due to the unique threads on select exemplary collets (as modified for the bore-riders), a specialized coupling 270 was designed and machined. The exemplary couple 270 incorporates tight 1.238"×20 right-hand (RH) internal threads and a perpendicular resting shoulder. These qualities ensured a tight and true alignment of the bore-riders 265, 275 as they are joined by the couple 270 to form the bore-rider assembly 815. A precise ½-inch hole for the annular chamber 490 drilled through the couple 270 provides secondary support for the rod 260, ensuring precise alignment for attachment to the module assembly 230.

The exemplary rod 260 at ½-inch diameter extends through the half-inch channels 430 in both rims 410 of the bore-riders 265, 275 and the annular chamber 490 of the coupling 270. The rod 260 has tapered wedges on each end: the flare 360 fixed at the fore and the detachable nut 290 at the rear. Upon translation, these wedges concurrently contact the respective collets 265, 275 expanding the outer diameter of their rims 410.

The exemplary rod 260 includes a ⅜-inch threaded end that facilitates precise positioning of the nut 290 to adjust its axial position on the rod 260. The rod 260 can be precisely machined to ensure perfect concentric fit and alignment between the flare 360 and module assembly 230. The fore button 350 has an axial ¼-inch hole 720 tapped in the tip 710 allowing for the rod 260 and module assembly 230 to be bolted together. A ⅛-inch hole can be drilled through the aft end of the rod 260 just ahead of the threads, enabling insertion of the spring pin 285, which secures the spring 280 that applies constant force on the rod 260 to maintain integration within the bore-rider assembly 815.

The exemplary module assembly 230 includes an aluminum tube 250 with a length of six-and-one-half inches and an outer diameter of two inches. The lenses employed for this bore sight enable the module assembly 230 to contain only the camera 225 and a partial lip of the lens 215. The module assembly 230 attaches to the wedge rod 260 through a concentric ½-inch hole. To ensure precise alignment, the fit between both parts can be an interference fit, held together by the bolt 235 and washer 240. To ensure precise alignment of the camera and bore-riders, eight set screws 255 are disposed around the camera tube 250; enabling fine calibration of the optical assembly.

Camera and laser analysis have been employed to select the most appropriate sensor size for providing a clear view of distant targets. Research indicated that a charge-couple device (CCD) camera provided the best video signal due to pixel's charge conversion to voltage, which can be buffered and transferred through a single node as an analog signal. Another aspect of the camera 225 to be determined was the sensing area and number of pixels needed for a quality picture. The smallest camera currently available with standard sensing and pixel specifications yielded a sensing area of 6.4 mm×4.8 mm and pixels 768×494. Selection led to the Sony XC-555 Color CCD camera being the preferred available and cost-effective option.

The desired field of view necessary for current range testing required the camera 225 to view a target at 300 yards with considerable accuracy. To obtain the desired field-of-view, camera characteristics include accounting for pixel count and sensing area. Utilizing a 100 mm lens and a 2× fixed focal length lens extender that increases the lens power to 200 mm provides a field of view of 31-feet×31-feet. This enables the camera 225 adequate view power to observe an object ¾-inch×1.5-inch in size, which satisfies the desired field-of-view for the camera bore sight. Consequently, the outer diameter of the 100 mm lens being used is 1.927-inch, so the smallest muzzle the bore sight can be inserted into corresponds to a 57 mm gun. This gives the bore sight an adaptable range of 57 mm to a 155 mm gun barrel range. However, this range could be lowered depending on the outer diameter of the optic or laser being used.

With many lasers available on the market, selecting a preference involves small size with ability to be mounted concentrically. A tube-mounted laser facilitates calibration for mounting on a bore sight device. Helium-neon and diode lasers are the prominent choice because of their concentric placement within a tube. Due to extended range operations the laser may be preferred, necessitating a beam expander on the laser. The specific type of beam expander may be a Galilean beam expander using a Plano-Concave lens and an achromatic lens to collimate the beam for reducing the laser spot size at a given distance.

Depending on the type, both gas and diode laser presumably perform comparably in range and accuracy. With the helium-neon laser averaging ±1.0 mrad parallel to outer cylinder and a beam divergence of ±1.2 mrad. The diode laser averaging beam versus housing alignment >3 mrad and a beam divergence of >3 mrad. Although gas lasers may perform slightly better than diode lasers, there are some draw backs with their use in bore sight application. Gas lasers are considerably larger than the diode lasers, averaging around ten-inches in length by 1.74-inch in diameter. A gas laser's operational life span may also be considerably less than that of a diode lasers; averaging around 40,000 hours compared to a diode's life of 50 hours to 100,000 hours of operation. Incorporating high-performance structured light laser diode modules represents the preferred selection for adapting a laser to any bore sight device.

The camera bore sight assembly package 810 includes two major sections: the aft portion including the bore-riders and the fore portion that houses the sight-mount. The aft portion with the bore-rider assembly 815 includes bore-riders 265, 275 that are assembled by joining two collets end-to-end in tandem with a steel couple 270. The fore portion consists of the module assembly 230 and the camera assembly 210. The two sections join by the center wedge rod 260 bolted to the module assembly 230.

To ensure both sections remain intact, a spring 280 is disposed within the extensions 450 of collets to secure the rod 260 to the coupling 270. The joining of both sections by the spring 280 provides a force to pull the module assembly 230 into the fore bore-rider 265. The spring 280 engages the wedges as the flare 360 and the nut 290 in corresponding channels 230 of their respective bore-riders 265, 275. Upon completion of the assembly package 810, the bore sight is ready for integration within the desired gun.

Integration process of the bore sight assembly package 810 to within the origin 930 of bore employs cables 820, 830, 870 of 3/16-inch diameter that span the length of the gun barrel 920. The process of integration begins by pulling the rear cable 870 through the barrel 920 by the retraction of an extendable tape measure attached to the rear handle 980. The rear cable 870 can then be secured around the aft bore-rider 275, with which to pull the assembly package 810 through the barrel 920. The front cable 820 attaches to the front handle 950 and around the fore bore-rider 265, providing bidirectional control in the barrel 920 for the bore sight. The module cable 830 can be wrapped around the module assembly 230 at the flare 360, enabling control to withdraw the bore-rider assembly 815 from the barrel 920.

To secure the bore sight within the barrel 920, the assembly package 810 is pulled to the origin 930 of bore and held in place by the cables 820, 830, 870. The camera module cable 830 is then pulled, separating the module assembly 230 from the bore-riders 265, 275 by several inches. The module cable 830 is then released, causing the module assembly 230 to spring back lodging the wedges (flare 360 and nut 290) into the channels 430 by the rod 260 snapping back due to the spring 280. This fixes the bore sight within the barrel 920. In the secure configuration, the gun can either be sighted in or used for target tracking.

Removing the bore sight can be accomplished by pulling the camera module cable 830, which separates the wedges from the channels 430, relieving their force. This collapses the rims 410 to reduce their relaxed outer diameters, returning mobility of the assembly package 810 within the barrel 920. In the release configuration, the bore sight can be readily removed from the barrel 920, completing the integration process.

Hardware associated with camera and laser can be translated with the bore sight along the barrel 920 from the muzzle 940 during installation. Electrical power and video-signal cables can extend from the point of entry at the muzzle 940 to the bore sight. Cables can be attached to exterior surfaces of the gun, enabling the gun to slue about without concern of damaging any connection that may exist between video monitors and bore sight.

Figure 10:
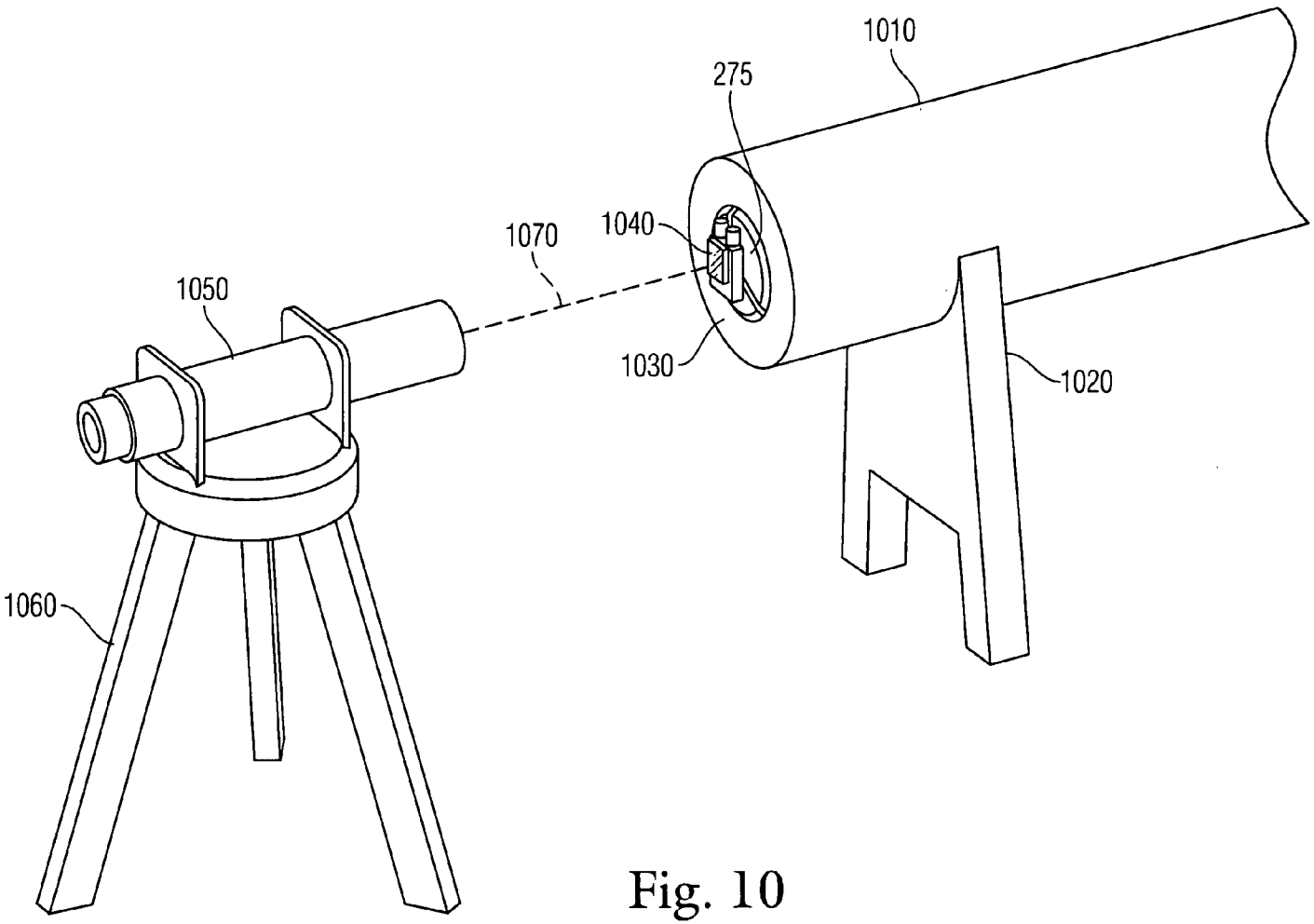
FIG. 10 is an isometric exploded view of an experimental configuration for alignment calibration.

FIG. 10 is an isometric view 1000 of an alignment calibration exercise for determining error associated with the bore-riders and bore of a 76 mm gun barrel 1010 on a support stand 1020. A mirror mount 1030 at one end of the gun barrel 1010 secures a mirror 1040. A subcollimator 1050 is mounted on a tripod 1060 with a line-of-sight to the mirror 1040 opposite.

Testing was conducted in order to determine the alignment of the bore-riders within the bore of the 76 mm gun. This involved mounting the mirror 1040 on the front face of the bore-riders and measuring concentricity with the autocollimator 1050, which constitutes an optical instrument used to measure angles by projecting a reticle on a surface of the mirror 1040 and measuring the displacement of the return image.

The experimental setup included the 76 mm barrel 1010, mirror mount 1030, mirror 1040, bore riders, and autocollimator 1050. The bore-riders were disposed within the muzzle of the 76 mm barrel 1010, the mirror 1040 mounted on the front face of the bore-riders with a screw, and then aligning the autocollimator's image on the mirror 1040. After alignment, the return image was viewable from the optical objective on the rear side of the autocollimator 1050. To determine alignment, the bore-riders remained not engaged, leaving two-thousandths of an inch clearance between the bore-riders and the bore. The clearance permitted free rotation, which revealed an area-of-run out between the two reticles. Further testing was conducted by sliding the bore-riders down the entire length of the 76 mm gun barrel 1010 to identify any error that might occur throughout the barrel.

Test results indicated a one-arc-minute displacement, as the bore-riders were being rotated, and no displacement as the bore-riders were translated (without rotation) throughout the bore length. This indicates that for the gun to be sighted in on a target at 300 yards, there would be a three-inch misalignment on the target. However, the displacement is expected to significantly diminish upon engagement of the bore-riders, which centers them within the bore. Further testing may include mounting the camera in the bore sight and measuring alignment with a similar process as mentioned previously.

Various embodiments described configure the initially fabricated bore sight for use with a camera. However, future adaptabilities include mounting a laser in lieu of the camera for quick target alignment. Other prospects include mounting a wide-angle lens on the camera to enable the bore sight to be transformed into a bore scope.

This would provide gun crews the ability to quickly inspect the bore for any indications of wear on the lands or chrome lining. The bore sight can also be adapted to smaller guns depending on the size of lens needed for target alignment. Artisans of ordinary skill will recognize that these represent only exemplary embodiments for modifications, and that others can be envisioned without departing from the scope of the claims to enable the bore sight adaptability to various guns by precise and interchangeable bore riders.

Various exemplary embodiments provide an adaptable bore sight capable of fitting at any linear position within multiple sized gun bores. The device has the capability of mounting either a laser or camera for target alignment. The incentive for such a design developed from the error introduced in conventional muzzle-mounted bore sights. Due to barrel droop, muzzle mounted bore sights align the gun to fire higher than intended. Disposal of the bore sight at the origin of bore rather than the muzzle reduces error associated with barrel droop, thereby drastically improving gun alignment on targets.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus for axially traversing a barrel of a gun through a bore and disposing at a select position therein, said barrel terminating at a muzzle and a breech, said apparatus comprising:

a bore-rider assembly for entering the muzzle, sliding within the bore of the barrel, and anchoring to the select position, said bore-rider assembly including:

first and second bore-riders with an axial channel between proximal and distal ends, each bore-rider having a rim at said distal end and an extension at said proximal end, said rim having an outer diameter adjustable by expansion, and a sleeve couple joining in tandem, at each axial end, said each bore-rider from said proximal end, said couple having an axial cavity;

a rod passing through said channel of each said bore-rider and said cavity of said couple, said rod having rod fore and aft ends with respective fore and aft wedges that engage said rims of corresponding bore-riders; and a sight-mount assembly for projecting a line-of-sight from the select position to the muzzle, said sight-mount assembly including:

a housing having an open fore end for containing a sighting mechanism and a housing aft end, and a connector for securing said housing aft end to said rod fore end.

2. The apparatus according to claim 1, wherein said rim includes an angularly symmetric plurality of slits therethrough, said slits continuously extending into said extension.

3. The apparatus according to claim 2, further comprising:

a first cable extending from the breech, passing through one slit of said plurality of slits in said rim of said first bore-rider, and looping around said extension of said first bore-rider; and a second cable extending from said muzzle, passing through one slit of said plurality of slits in said rim of said second bore-rider, and looping around said extension of said second bore-rider.

4. The apparatus according to claim 3, further comprising:

a third cable that splits to pass through two slits of said plurality of slits in said rim of said second bore-rider, and loops around said fore wedge behind said housing aft end.

5. The apparatus according to claim 1, wherein said sleeve includes female threads at both said ends, and both said extensions of said bore-riders include male threads that correspond to said female threads.

6. The apparatus according to claim 1, wherein said fore and aft wedges engage respective axial channels of said second and first bore-riders.

7. The apparatus according to claim 1, wherein said rod comprises:

a shaft having fore and aft ends;

a flare representing said fore wedge disposed adjacent said rod fore end;

a nut representing said aft wedge disposable at said rod aft end, said nut being axially adjustable along said shaft; and a land at said rod fore end for engaging said housing aft end.

8. The apparatus according to claim 7, wherein said land corresponds to a fore end of said flare.

9. The apparatus according to claim 1, wherein either of said wedges is positionally adjustable along said rod.

10. The apparatus according to claim 1, wherein said sighting mechanism is a camera with a lens.

11. The apparatus according to claim 1, wherein said housing further includes a plurality of set screws to engage and secure said sighting mechanism therein.

12. The apparatus according to claim 1, further comprising:

a helical spring disposed along said rod between said fore and aft flares and within said channels of said bore-riders and said chamber of said couple; and a restraint to fixably dispose one end of said spring along said rod.

* * * * *